US005450802A

United States Patent [19]

Horvath et al.

[11] Patent Number: 5,450,802

[45] Date of Patent: Sep. 19, 1995

[54] FLUIDIZED BED COMBUSTION APPARATUS WITH PARTITIONED COMBUSTION CHAMBER

[75] Inventors: Ferenc Horvath; Karoly Remenyi; Laszlo Voros, all of Budapest, Hungary

[73] Assignee: Villamosnergiaipari Kutato Intezet, Budapest, Hungary

[21] Appl. No.: 157,372

[22] Filed: Nov. 23, 1993

[51] Int. Cl.[6] ..... F23G 5/00

[52] U.S. Cl. ..... 110/245; 122/4 D; 34/590

[58] Field of Search ..... 122/4 D; 110/245; 422/143; 165/104.16; 432/58; 34/577, 589, 590; 431/7

[56] References Cited

U.S. PATENT DOCUMENTS 4,864,944 9/1989 Engström et al. ..... 122/4 D X
4,879,958 11/1989 Allen et al. ..... 110/245
4,917,025 4/1990 Buchmüller et al. ..... 110/245
5,325,823 7/1994 Garcia-Mallol ..... 122/4 D

*Primary Examiner*—Denise L. Gromada
*Attorney, Agent, or Firm*—Ladas & Parry

[57] ABSTRACT

A fluidized bed combustion apparatus having an upright combustion chamber with a lower end at which a fluidized bed is formed and combustion takes place. First and second upright partitions are provided in the combustion chamber to divide the combustion chamber into a plurality of sections. The first partition divides the combustion chamber into first and second sections which are joined together by a turning space above an upper end of the first partition and the second partition is hollow and has an open, upper end in communication with the turning space to receive a portion of the combustion products therein. The lower end of the second partition is open to supply the combustion products to the fluidized bed.

6 Claims, 2 Drawing Sheets

FLUIDIZED BED COMBUSTION APPARATUS WITH PARTITIONED COMBUSTION CHAMBER

FIELD OF THE INVENTION

The invention relates to a circulated fluidized firing system including a coal-crusher including drying and feeding equipment, an air-distributer for realizing fluidized firing, a multi-stage air-blower, deslagging and starting equipment, a wall with or without cooling dividing the combustion chamber, a turning chamber by the aid of which fuel will be divided into two parts in the combustion chamber, one part being rich in fuel, the other part being lean in fuel, furtheron the system comprises equipment for separating pulverized coal from the gas flow being rich in coal within the combustion chamber and leading it into the proper part of the divided fluidizing bed.

BACKGROUND

With known methods of fluidized combustion, properly prepared fuel (coal) is led onto the fluidizing bed on which in fluidized state it will be either combusted or it becames a gaseous media. The temperature of the fluidizing bed and thus the heat quantity to be released in the fluid bed will be determined partly by the melting properties of the coal-ash, partly by ecological requirements (removal of sulphur, arising from nitrogenoxide etc.) Released heat will be utilized mostly for evaporating energetic working media, heating feed-water or air, and preparing hot water.

With fluidized combustion, in order to increase yield of heat release, instead of the so-called buffled fluidizing bed (material of bed and most part of the coal remain on the fluidizing bed), the so-called circulated fluidization used to be applied, with which prior to final combustion, fuel (coal) is subjected to repeated separation and process of leading back onto the fluidizing bed. A drawback of the aforementioned circulated combustion is that complicated apparatuses are required, and the utilization of heat transferring surfaces relatively low.

With the known solution of fluidized combustion fuel (coal) used to be fed above the distributor assuring equal air distribution. In dependence of the speed of fluidization (1–3 m/s) the burble-fuel forms the mixture of the bed-forming material, fuel, air, combustion product, the said mixture to be found above the fluidizing bed, while in the case of a quick fluidization (2–14 m/s) fluidized combustion is taking place including material flow leaving the fluidizing bed. Quick fluidized combustion used to be realized by establishing circulation-firing, as full combustion can be obtained only by repeated circulation. With this solution usually immediately after the direct combustion chamber, a separately arranged separating high temperature fan is inserted for recycling the not fully combusted coal into the combustion chamber. Full combustion of fuel (coal) becomes possible—in dependence of quality—after having performed circulation of about 5–20 times.

Realization of fluidized combustion using conventional methods has several disadventageous features.

In the course of realizing circulated fluidization combustion, a separately arranged precipitator must be operated at high temperature (800°–900° C.). Such a precipitator is a most complicated prece of equipment and use of special materials will be required.

As for utilization of heat, the fan is less useul, as either it is without cooling or heat transfer is low. From the point of firing, circulated fluidization combustions have several disadvantages, such as an air requirement needed for combustion of fuel (coal) could be met only with difficulty.

SUMMARY OF THE INVENTION

The object of our invention is to provide a fluidized bed system which eliminates the drawbacks of the known systems.

By means of the equipment according to the invention the above and other objects are achieved, as properly prepared fuel (coal) is ed onto the fluid bed having been divided into sections, it is mixed with air in compliance with combustion and thus combusted; furtheron after having divided the combustion chamber in several sections, ideal circumstances of combustion an heat transfer, excellent circulation of fuel can be obtained.

The firing equipment is insensitive to coal quality, as after having properly prepared coal (drying, grinding) adequate combustion circumstances can be met. In the hole combustion chamber, the temparature will be in compliance with fluidized firing (800°–950° C.), accordingly advantages can be obtained in respect to ecology. In the whole system material flow is self-adjusted because with the fluidizing bed divided into sections, pressure conditions and material quantity, lying on the bed, establish the required state of equilibrium, while the proper distribution of gas flow can be achieved by properly dimensioned free cross sections. The solution promoting gas and dust circulation is also considered as advantageous. Feeding of additives for educing sulphur oxide emission being determined from point of wiev of ecology are well known solutions.

Divided fluidizing bed and combustion chamber yield the possibility to combust mixed fuels of different quality as firing equipment complies well with firing requirements.

Even with coals of inferior quality, with smaller loads stable combustion can be achieved.

Essential advantege of the hybrid circulated fluidized combustion according to the invention lies in that fuel (coal) will be burnt to its full extent under the circumstances of circulated fluidizing combustion. Within the combustion chamber dust precipitation having been achieved by proper construction and proper recirculation of the fuel (coal) can be obtained simultaneously forming well utilized heat-exchanging surfaces. The equipment is simple, it can be used at low costs for the reconstruction of existing boilers.

The equipment according to the invention will be described in detail by means of a preferred embodiment illustrated in the drawing.

DETAILED DESCRIPTION

Figure 1:
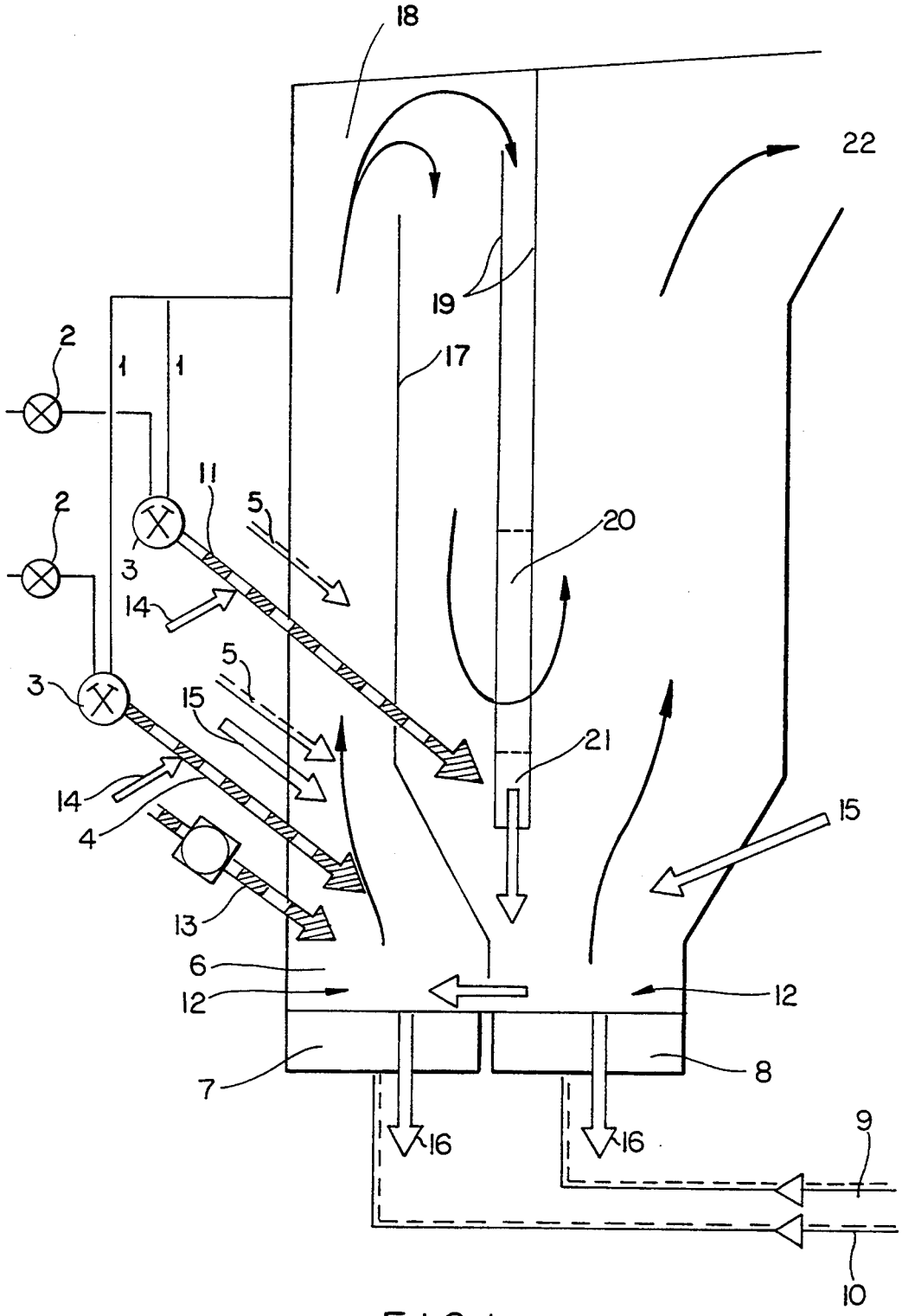
FIG. 1 is a diagrammatic, sectional view of the fluidized bed combustion equipment according to the invention.
Figure 2:
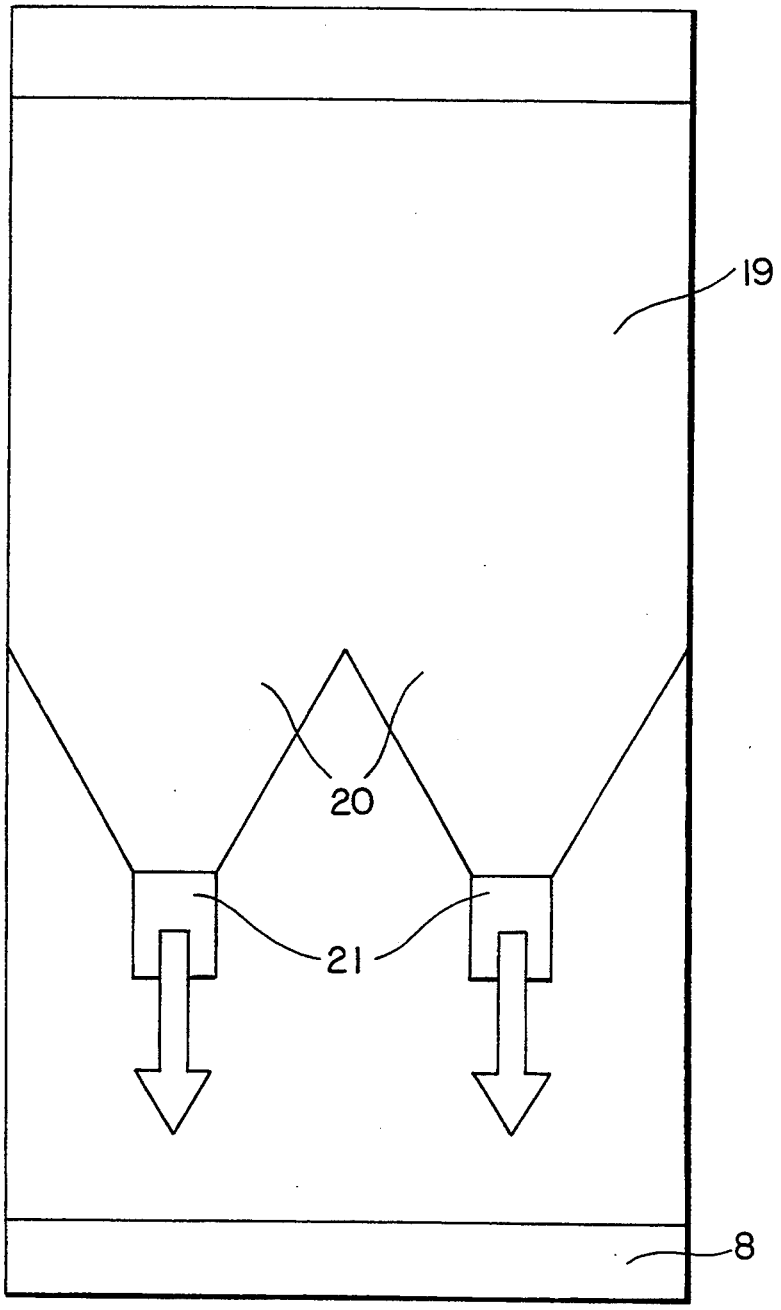
FIG. 2 illustrates a modification of the equipment of FIG. 1.

With the embodiment—serving here as an example—a coal preparatory unit draws off hot gas from the combustion chamber through the line 1 for drying, crushing and delivery of the coal. Feeder 2 feeds the coal into said line. A coal preparatory unit 3 grinds the coal to the required grain size and feeds it to the line 4 interconnected with the boiler. Coal may be supplied from the coal preparatory unit 3, but it may come from other pulverized coal sources having been operated indepently from the boiler. The line 4, feeding the coal into the boiler, can be connected to the top, to any side or corner of the boiler. Line 5 supplies air in compliance with combustion. Fluidizing air flows in the direction of the arrows through lines 9 and 10 beneath an air distributor 7, 8 arranged at the bottom of the combustion chamber 6. Advantageously air distributor 7,8 is divided into sectors; accordingly speed and quantity of fluidizing air can be controlled for each sector, and thereby favorable flowing conditions can be controlled.

In the coal feeders 4,11 different coal types or differently prepared coals can be ed in. In the latter case coal preparatory units 3 may be equipment of similar construction but set to diverse operational parameters. In special case coal can be fed through the line 12 to the bottom of the fluidizing bed. Coal supply may be realize by using a spreader 13. In all case through lines 9,10 a quantity of air should be fed into the system which suffices—together with other air inputs 5—for combustion of coal introduced through lines 4,11 and 13 to the combustion chamber. The temperature of the fluidizing bed and the combustion chamber can be adjusted by controlling the air quantity.

Additives for binding sulphur oxides will be introduced through line 14 and/or 15.

Solid incombustible materials, remaining after combustion, are removed through deslagging lines 16.

Wall 17 divides the combustion chamber into two parts, one part for quick fluidization and one for slow fluidization. Turning space 18 separates dust from the flue with a high concentration of combustible material, using a small quantity of flue gases, after the flue is leaving the space 7 for quick fluidization; thereafter wall 19 separates external flow rich in dust from the diluted inner flow.

One or more conically formed chamberparts 20 lead the flow, being rich in dust, above the section for slow fluidization for recycling non combusted dust, while the lean flow of gas, containing fine combusted dust, after having been separated from the gas flow, being rich in dust, will be united with combustion products of the slow fluidization and it allowed to blow towards the convective heating surfaces 22. Elements 19,20, separating about 70–85% of the total dust quantity, are assembled expediently from preferably parallel, at the bottom conically narrowing, gas proof heating surfaces; these are closed on both sides, openings are formed only at the gas input at the top and on the discharge at the bottom of the leg of the cone.

As it is obvious from the description of the equipment according to the invention, serving here as an example, it enables realization of circulated combustion with divided sections without fans with high temperature used generally with circulation fluidizing boilers.

A significant advantage lies in that also with coals of inferior quality excellent combustion efficiency can be obtained simultaneously realizing optimal conditions of ecology.

We claim:

1. A fluidized bed combustion apparatus comprising an upright combustion chamber having a lower end at which a fluidized bed is formed and combustion takes place, first and second upright partitions in said combustion chamber dividing the combustion chamber into a plurality of sections, the first partition dividing the combustion chamber into first and second sections which are joined together by a turning space above an upper end of said first partition to enable upflowing combustion products in the first section to flow downwardly into the second section to the fluidized bed, means for supplying air and fuel to said combustion chamber to achieve combustion therein at the fluidized bed, said second partition being hollow and having an open upper end in communication with said turning space to receive a portion of the combustion products therein, said second partition having an open lower end to supply said portion of the combustion products to said fluidized bed.

2. A fluidized bed combustion apparatus as claimed in claim 1, wherein said first partition has a lower end inclined towards said second partition and extending below the open lower end thereof.

3. A fluidized bed combustion apparatus as claimed in claim 1, wherein said second partition forms a third section in said combustion chamber having a discharge opening at an upper end of said third section.

4. A fluidized bed combustion apparatus as claimed in claim 3, wherein said second partition is tubular.

5. A fluidized bed combustion apparatus as claimed in claim 4, wherein said second partition extends to a top wall of the combustion chamber to separate the second and third sections thereat.

6. A fluidized bed combustion apparatus as claimed in claim 1, wherein said second partition has two openings at said lower end thereof, said second partition including two, conically tapered portions at said lower end respectively provided with said openings.

* * * * *